US006622684B1

(12) United States Patent
Stinaroff et al.

(10) Patent No.: US 6,622,684 B1
(45) Date of Patent: Sep. 23, 2003

(54) UNITARY ENGINE BLOCK HAVING AN INTERMITTENT CONTACT INTAKE AND EXHAUST LIFTER SYSTEM

(76) Inventors: Dimitri Stinaroff, 64-19 232 St., Bayside, NY (US) 11364; Diana Stinaroff, 64-19 232 St., Bayside, NY (US) 11364

( * ) Notice: Subject to any disclaimer, the term of this patent is extended or adjusted under 35 U.S.C. 154(b) by 0 days.

(21) Appl. No.: 10/389,178

(22) Filed: Mar. 14, 2003

(51) Int. Cl.[7] ..... F02N 3/00
(52) U.S. Cl. ..... 123/188.4; 123/81 B; 123/51 A
(58) Field of Search ..... 123/188.4, 81 B, 123/51 A

(56) References Cited

U.S. PATENT DOCUMENTS

| | | | |
|---|---|---|---|
| 4,735,186 | A | 4/1988 | Parsons |
| 5,193,493 | A | 3/1993 | Ickes |
| 5,596,955 | A | 1/1997 | Szuba |

FOREIGN PATENT DOCUMENTS

| | | | |
|---|---|---|---|
| JP | 57-171012 | * | 10/1982 |
| JP | 59-23015 | * | 2/1984 |

* cited by examiner

*Primary Examiner*—Noah P. Kamen
(74) *Attorney, Agent, or Firm*—Collard & Roe, P.C.

(57) ABSTRACT

An intake and exhaust system for an internal combustion engine having a unitary engine block the system comprising a power cylinder, an intake lifter cylinder and an exhaust lifter cylinder that are formed integral with the engine block. This engine block has an intake port, and an exhaust port for allowing exhaust to flow there through. Inside the piston or power cylinder is a power piston which is driven by a crank shaft connected by connecting rod which extends through the power cylinder. This crank shaft is driven by a movement of the power piston which is caused by combustion of gasses inside the engine block. There is also a cam shaft which disposed within the engine block. This cam shaft is found on a top section of the engine block. Coupled to the cam shaft is a timing chain which is also coupled to said crank shaft. Thus, as the crank shaft rotates, it drives the timing chain which in turn rotates said cam shaft. To control the flow of exhaust gasses and the intake of air mixture, there is an intake lifter disposed in the engine block adjacent to the engine block intake port. There is also an exhaust lifter disposed in the cylinder adjacent to the exhaust port. To drive the intake lifter and the exhaust lifter, there is at least one oblong cam disc coupled to the cam shaft wherein this at least one oblong cam disc is for driving the intake lifter and said exhaust lifter intermittently so that exhaust can flow through the engine block from the intake port and out of the exhaust port.

8 Claims, 7 Drawing Sheets

EXHAUST

POWER

COMPRESSION

INTAKE

UNITARY ENGINE BLOCK HAVING AN INTERMITTENT CONTACT INTAKE AND EXHAUST LIFTER SYSTEM

BACKGROUND

The invention relates to an improved design for a unitary engine block and an improved design for an intake and exhaust lifter system for this style engine block for internal combustion engines.

Internal combustion engines are usually either two stroke or four stroke engines which usually run on the combustion of gasoline or diesel fuel. In the past, internal combustion engines have comprised engine blocks and cylinder heads as two separate components.

In addition, these type combustion engines have shown exhaust systems having tie rods connecting cam shafts to intake and exhaust pistons.

Internal combustion engines are shown in U.S. Pat. No. 5,193,493 to Ickes and U.S. Pat. No. 5,596,955 to Scuba. The present invention differs from the above referenced art in that the present invention presents an engine block that incorporates both the block and the cylinder head construction in a single casting to form a unitary engine block construction which only has a cover to cover the cylinders.

SUMMARY

One object of the invention is to provide a unitary engine block that does not contain a separate cylinder head.

Another object of the invention is to provide an internal combustion engine that is free of connecting rods or push rods.

Another object of the invention is to provide an internal combustion engine that is free of rocker arms.

Another object of the invention is to provide an internal combustion engine that does not contain any cylinder heads or gaskets or bolts.

Another object of the invention is to provide an internal combustion engine that contains intake and exhaust lifters.

Another object of the invention is to provide an internal combustion engine that is less expensive to manufacture due because of its simpler design.

To achieve these objects, invention relates to an internal combustion engine having an engine block that is cast as a single unitary engine block that removes the need for a cylinder head to be mounted on the engine block. Instead, this new internal combustion engine includes at least one, but preferably at least three cylinders which comprise a power cylinder an intake cylinder and an exhaust cylinder. These cast cylinders extend up to a cover to cover the unitary engine block. In addition, there is a novel intake and exhaust lifter system for each of the cylinders in the engine block. The intake cylinder has an intake port, and the exhaust cylinder has an exhaust port for allowing exhaust to flow there through. Inside each power cylinder is a power piston which is driven by a crank shaft which extends through the cylinder. This crank shaft is driven by a movement of the power piston which is caused by the combustion of gasses inside each of the cylinders. There is also a cam shaft which is disposed within the engine block. This cam shaft is spaced apart from the crank shaft and extends through the cylinder. Coupled to the cam shaft is a timing chain which is also coupled to the crank shaft. Thus, as the crank shaft rotates, it drives the timing chain which in turn rotates the cam shaft.

To control the flow of exhaust gasses and the intake of air mixture, there is an intake lifter disposed in the intake cylinder adjacent to the intake cylinder intake port. To release these gasses from each of the cylinders, there is also an exhaust lifter disposed in the exhaust cylinder adjacent to the exhaust port. To drive the intake lifter and the exhaust lifter, there is a cam disc which can be approximately kidney shaped and coupled to the cam shaft wherein this cam disc is for driving the intake lifter and the exhaust lifter intermittently and through intermittent contact so that exhaust can flow through the intake cylinder and the exhaust cylinder from the intake port and out of the exhaust port. The intake and exhaust lifters are essentially a plurality of components including a cylinder piston and a shaft.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1A:
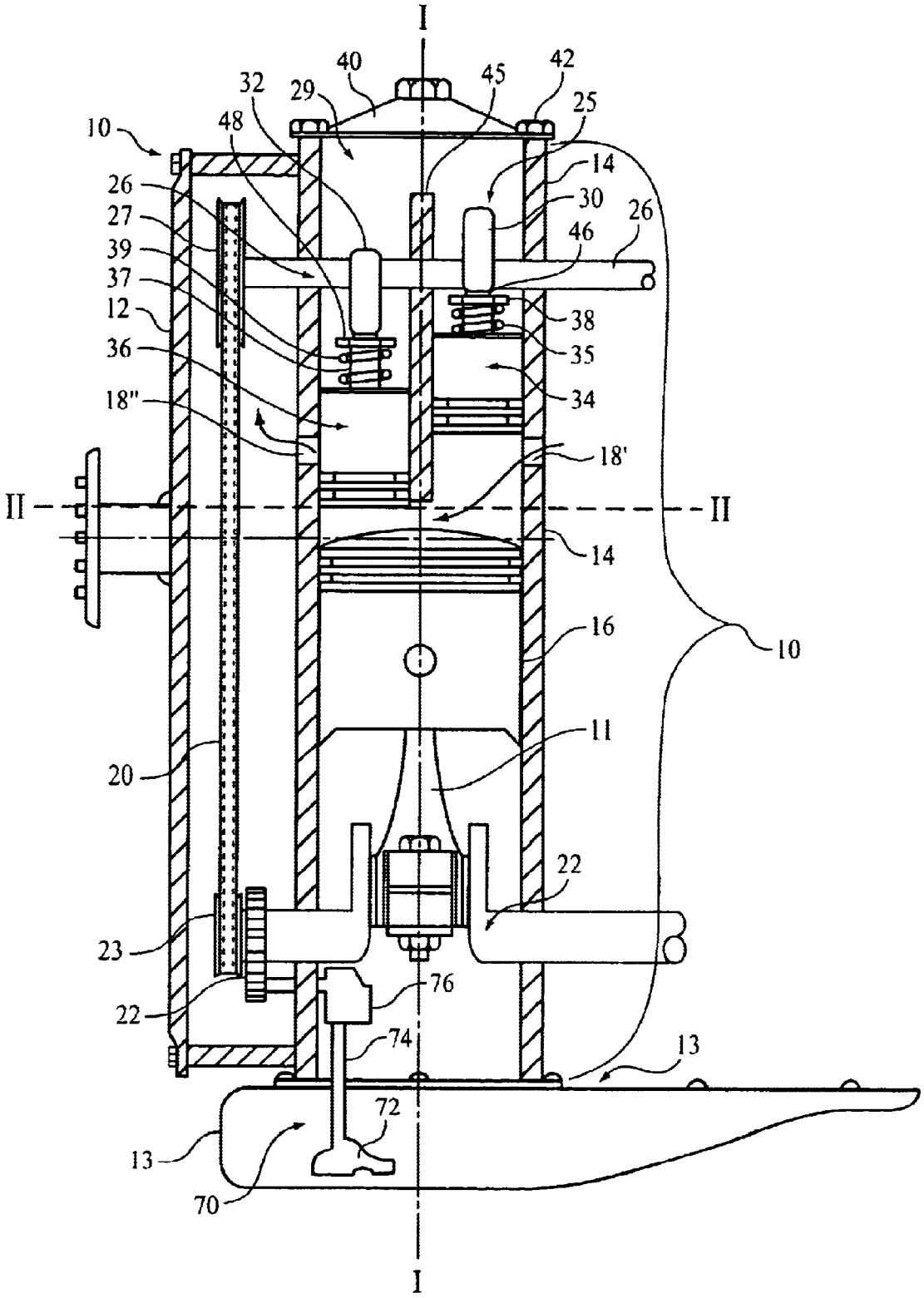
FIG. 1A is a cross-sectional view of a first embodiment of the invention.

Referring in detail to the drawings, FIG. 1A shows an internal combustion engine having a unitary engine block 10 is substantially covered in front by a front engine cover 12. This internal combustion engine block 10 contains a cooling and lubricating system, a power cylinder 14 and two cylinders 25 and 29. Power cylinder 14 is coupled at one end to oil pan 13 while cylinders 25 and 29 are coupled at an opposite end to removable cover 40. Removable cover 40 can be removed by unscrewing screws 42 for easy access to the intake and exhaust lifters. With this design, the engine block 10 is cast as a one piece or unitary engine block containing these three cast cylinders.

Figure 2:
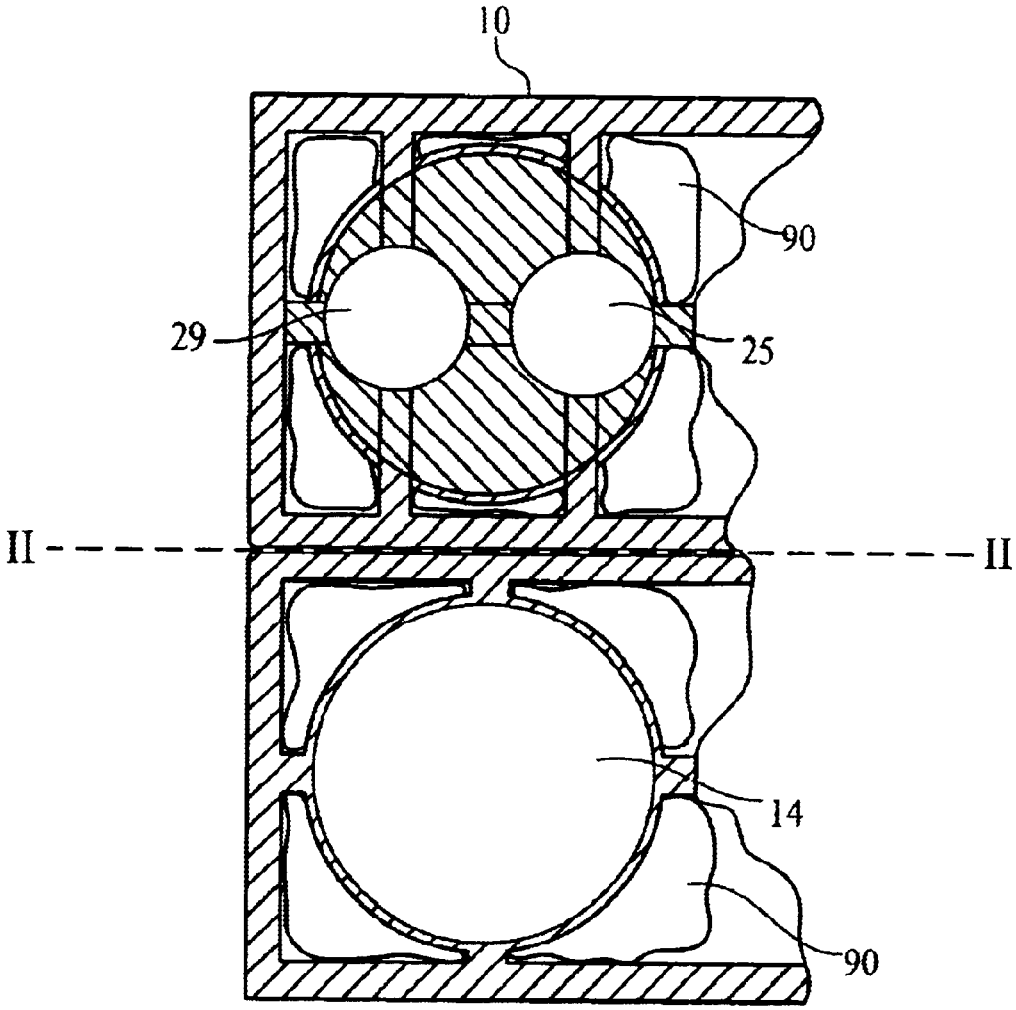
FIG. 2 shows a cross-sectional view of the engine block shown in FIG. 1A split open along line II—II.

Thus unitary engine block 10 has three main sections, a power section or cylinder 14 which houses power piston 16, an intake section or intake cylinder 25 and an exhaust section or exhaust cylinder 29 wherein these sections are divided by a cast portion of the engine block. (SEE FIG. 2) With this design, disposed in cylinder 14 along intake section 25, is an intake port 18'. Exhaust section contains an exhaust port 18". In the power section power piston 16 is disposed in cylinder 14 and a crank shaft 22 disposed in engine block 10 which extends through cylinder 14. Crank shaft 22 is coupled to power piston 16 via a connecting rod and is driven by a movement of power piston 16 caused by compression in cylinder 14. Essentially engine block 10 can be formed by one or more cylinders 14, 25 and 29. This design is shown more clearly in FIG. 2 which shows a cross sectional view of unitary cast engine block 10 which is cut and opened along line II—II. This view shows a middle to bottom view of power cylinder 14, and a middle to top view of intake cylinders 25 and 29 to illustrate that the engine block is cast as a single engine block 10 of at least three separate cylinders 14, 25, and 29. However, depending on the size of the engine block, these three cylinders could be repeated such that there could be four power cylinders 14 which as for example would form a "four cylinder engine". If there are six power cylinders then it would form a "six cylinder engine" or eight power cylinders then it would form an "eight cylinder engine." There are also cooling channels 90 which allow a coolant such as water to flow therethrough.

This design also includes a cam shaft 26 which extends through intake and exhaust sections or cylinders 25 and 29 in unitary engine block 10. Cam shaft 26 has a cam shaft gear 27 that connects to crank shaft 22 having a crank shaft gear 23 via a timing chain 20. As crank shaft 22 rotates, it drives timing chain 20 which in turn rotates cam shaft 26. Disposed inside of intake cylinder 25, is an intake lifter 34 disposed adjacent to intake port 18'. In addition, there is an exhaust lifter 36 disposed in exhaust cylinder 14 adjacent to exhaust port 18".

To drive intake lifter 34 and exhaust lifter 36 there is at least one oblong cam disc 30. Cam disc 30 is coupled to cam shaft 26 wherein cam disc 30 is for driving intake lifter 34 and exhaust lifter 36 intermittently via a touching effect so that combustion gasses can flow through piston cylinder from intake port 18' and out of exhaust port 18". The touching effect is essentially through intermittent contact between intake lifter 34 and exhaust lifter 36 and cam discs 30. This design with the intermittent touching effect, reduces the need for a lifter control cam shaft and removes the requirement for interconnected parts. Thus, because there are no interconnecting parts in this connection, there is the possibility for reduced wear due to the reduced number of connected components.

Essentially, intake lifter 34, and exhaust lifter 36 each have shafts 35 and 37 respectively, and are spring loaded in cylinder 14 with intake lifter being supported by an intake spring 38 and exhaust lifter being supported by an exhaust spring 39. On top of shafts 35 and 37 are contact plates 46 and 48 respectively which are used for intermittent contact with their respective lifters or cam discs.

In addition, there is an oil pump 70 which has an open receiving end 72 disposed in oil pan 13, a shaft 74 extending up from open end 72, and a body section 76 that stores oil that is to be pumped into working parts in cylinder 14.

Figure 3A:
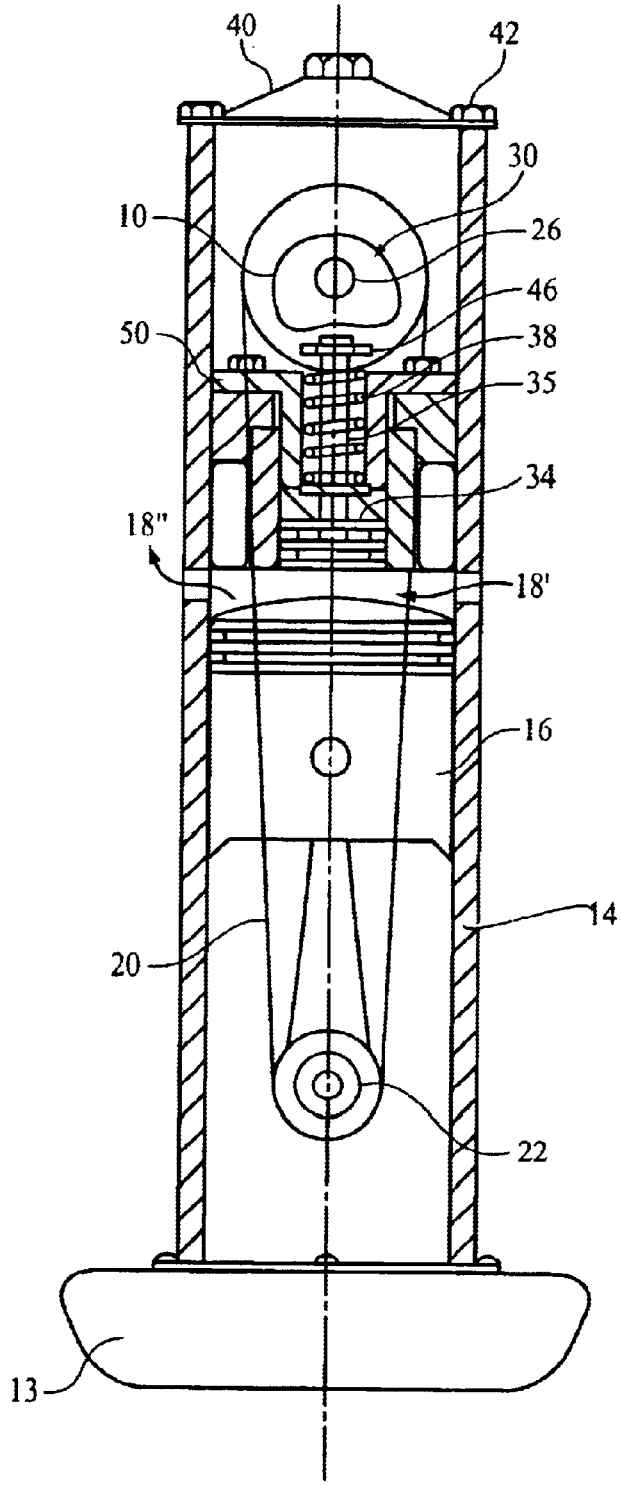
FIG. 3A is a second view of the device shown in FIG. 1B.

As shown in FIG. 3A, disposed inside of engine block 10, is a stationary plate 50. Stationary plate 50 can be used to support intake spring 38 (Shown in FIG. 3A) and exhaust spring 39 (Not Shown). Thus, as shown in FIG. 3A, as cam disc 30 rotates, it intermittently drives contact plate 46 coupled to shaft 35 down against spring 38 which compresses spring 38 against stationary plate 50. At this time, shaft 35 extends down through a hole in stationary plate 50 which allows piston 34 to drive down closing over intake hole 18' increasing the compression and pressure in cylinder 14. As cam disc 30 continues to rotate, spring 38 drives up against contact plate 46 pushing shaft 35 up and driving intake lifter 34 back up to open intake port 18'. This same intermittent contact effect occurs with exhaust lifter 36, when cam 32 compresses against contact plate 48 which drives down shaft 37 compressing spring 39 against stationary plate 50.

Figure 3B:
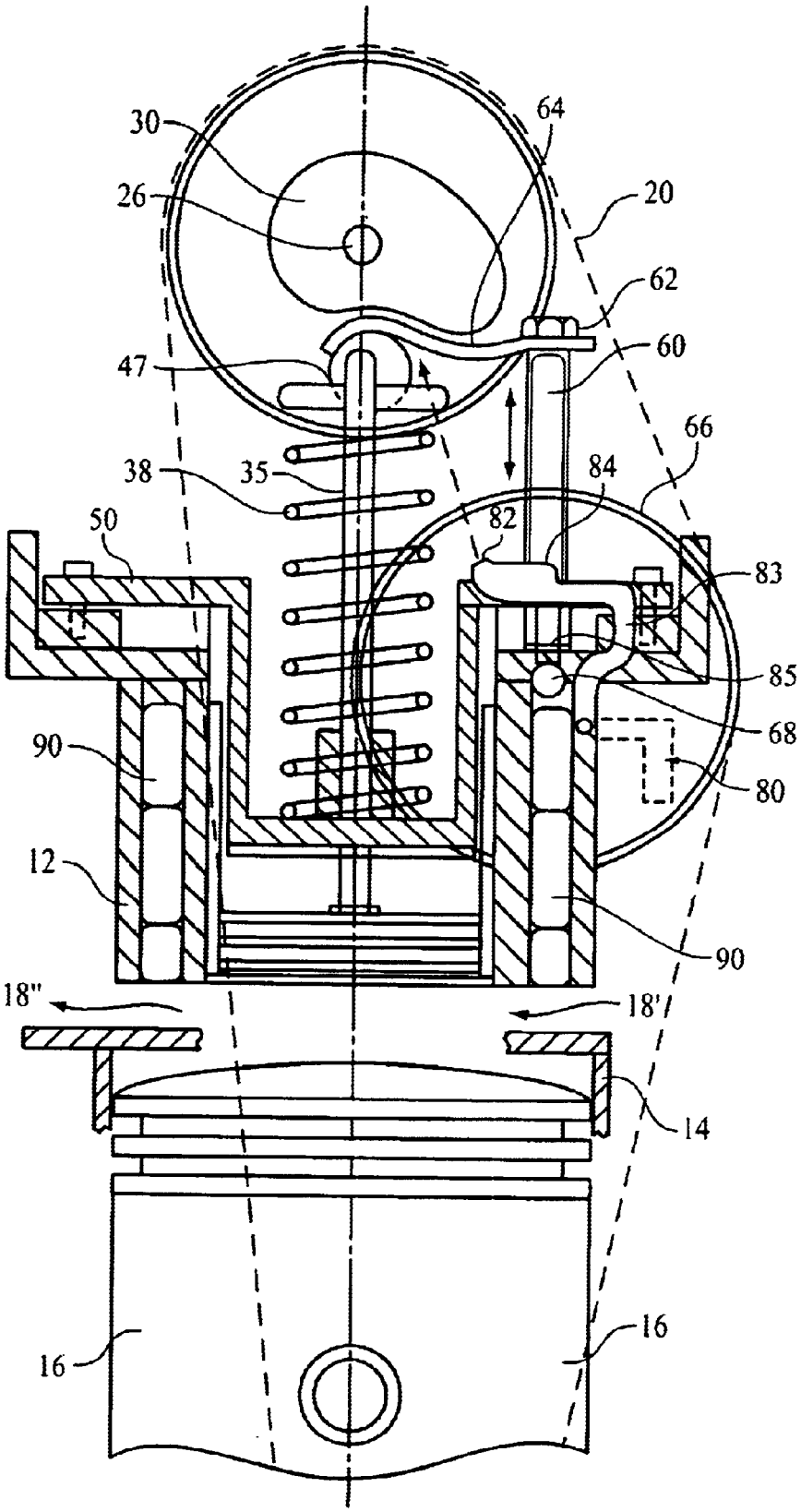
FIG. 3B is a second embodiment of the intake and exhaust lifter system according to the invention.

FIG. 3B shows another embodiment of the invention wherein engine block 10 is shown with stationary plate 50 supporting spring 38 between stationary plate 50 and contact head 47. Contact head 47 is coupled to shaft 35 such that as spring 38 pushes up on contact head 47, it drives shaft 35 up and also lifter 34 up as well. Once contact head 47 is driven back up, it contacts contact plate 64 which comes into contact with cam disc 30. Contact plate 64 is bolted to supplemental shaft 60 via bolt 62 wherein shaft 60 is used to supplement the driving effect of spring 38. Supplemental shaft 60 is driven by oil pressure within the engine block wherein as crank shaft 22 rotates, it drives timing chain 20 which in turn rotates oil pressure roller 66 which turns oil pressure shaft 68. Oil pressure shaft 68 controls the pressure of oil in the system wherein as oil pressure shaft 68 rotates it controls a valve to intermittently increase or decrease the pressure in the system to alternately raise or lower supplemental shaft 60 which is synchronized with the raising and lowering of contact plate 64. The oil that is provided for this hydraulic system flows from oil pump 70 shown in FIG. 1A up to entry port 80. The oil then flows through channel 83 until it is either sent into outlet port 84 which drives supplemental shaft up and down or out of outlet port 82 which sends oil into engine block 10 for use and then back down into oil pan 13.

Figure 1B:
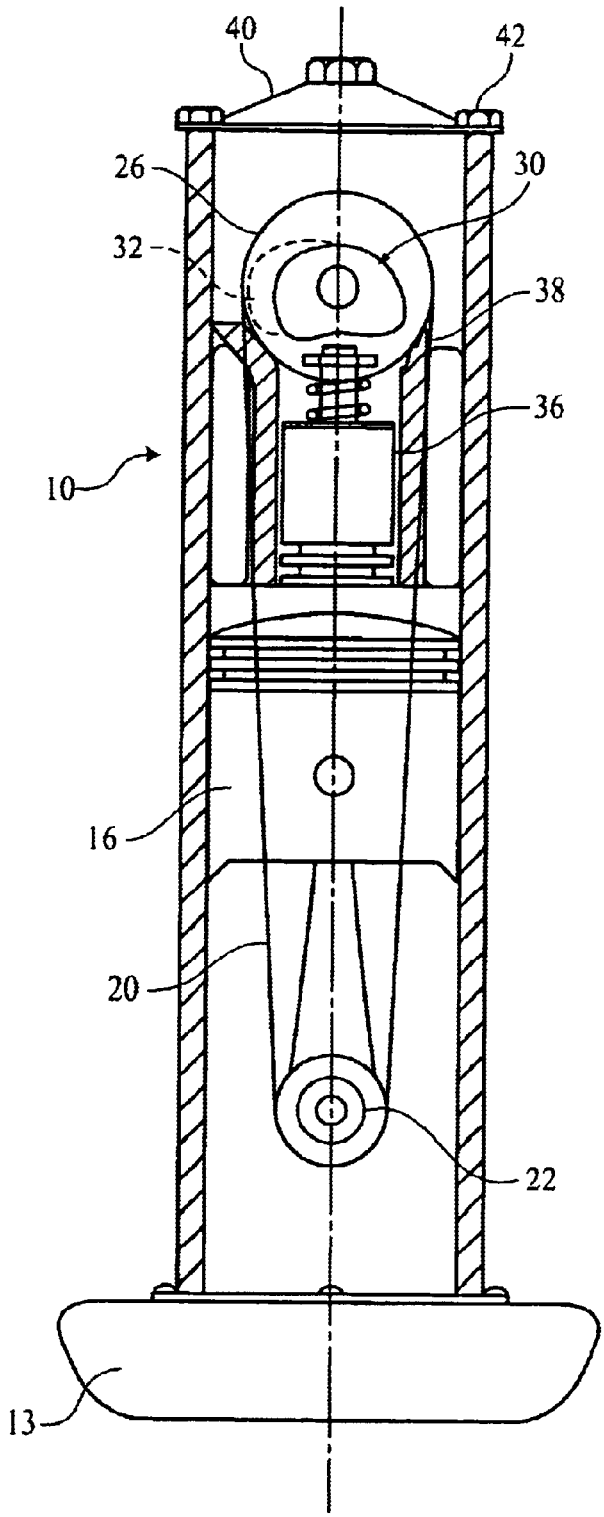
FIG. 1B is a cross sectional view of the device shown in FIG. 1A taken along section line I—I.

In both of these designs, top cover 40 as shown in FIG. 1A and in FIG. 1B is easily removable from the single unitary engine block comprising one or more cylinders. With this design, once the cover 40 has been lifted, cam shaft 26 and cam discs 30 and 32 or other components of the engine can also be removed and either replaced or repaired creating an easily repairable and reconstructable engine.

Figure 4D:
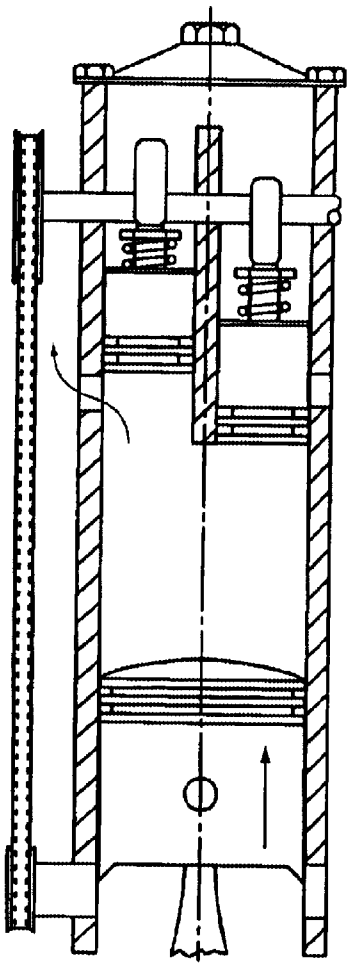
FIG. 4D is a view of the unitary engine block according to FIG. 1A in a fourth of four strokes.
Figure 4C:
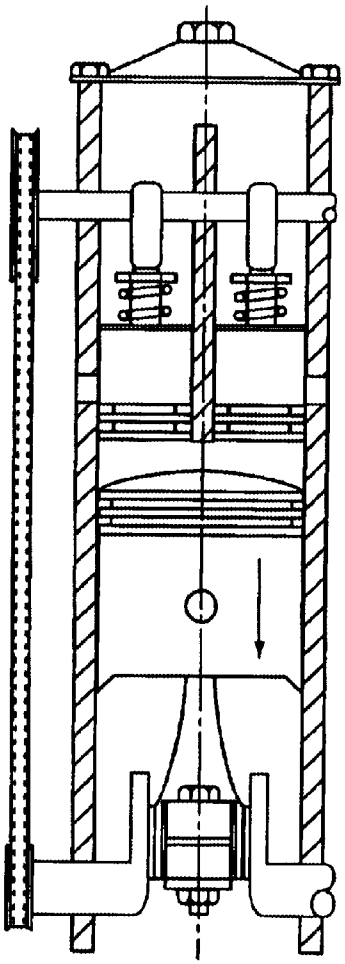
FIG. 4C is a view of the unitary engine block according to FIG. 1A in a third of four strokes.
Figure 4B:
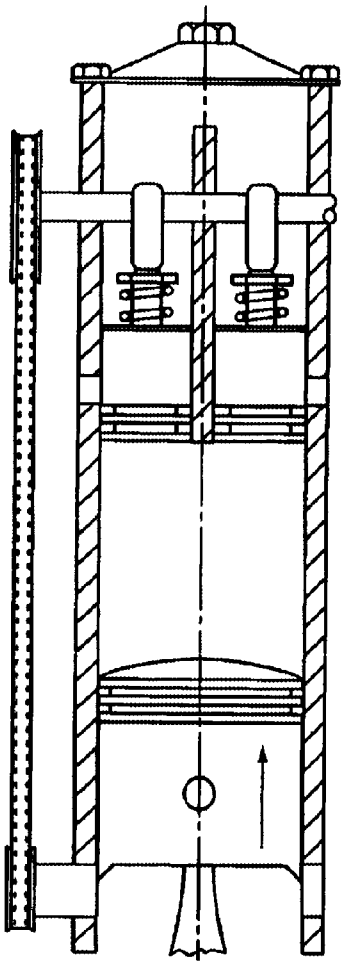
FIG. 4B is a view of the unitary engine block according to FIG. 1A in a second of four strokes.
Figure 4A:
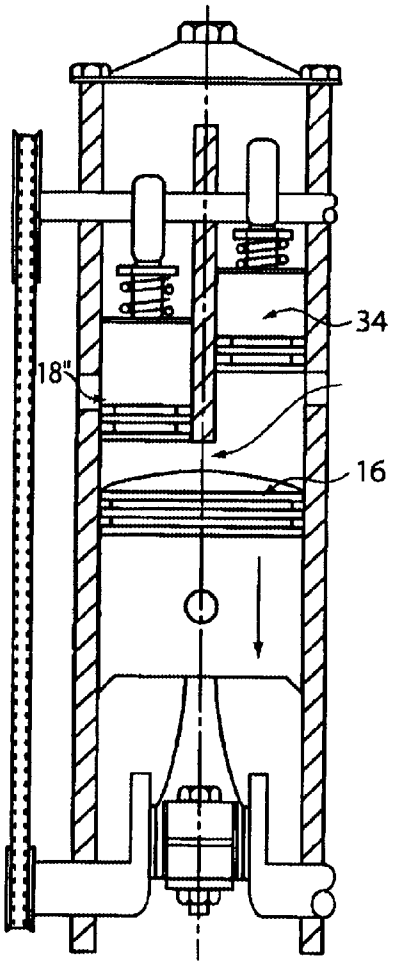
FIG. 4A is a view of the unitary engine block according to FIG. 1A in a first of four strokes.

FIG. 4A is a view of the engine block according to FIG. 1 in a first of four strokes. At this position, there is air mixture intake through intake port 18' with intake lifter 34 being positioned above intake port 18' so as to allow air mixture to flow into cylinder 14 to aid in combustion.

FIG. 4B is a view of the engine block according to FIG. 1 in a second of four strokes. At this position, intake lifter 34 has moved down so that it is even with exhaust lifter 36 and covering intake port 18'. This movement creates compression in cylinder 14 which drives power piston 16, 18 down and up.

FIG. 4C is a view of the engine block according to FIG. 1 in a third of four strokes. In this position, both intake lifter 34, and exhaust lifter 36 are positioned to cover intake port 18' and exhaust port 18". At this point, power piston 16 is raised up to create a power stroke inside of cylinder 14 which when the air mixture is ignited provides full power for power piston 16 moving up and down.

FIG. 4D is a view of the engine block according to FIG. 1 in a fourth of four strokes. In this position, power piston 16 is down and moves up while exhaust lifter 36 moves up to a position above exhaust port 18". In this position, combusted gasses disposed in cylinder 14 are released to make room for additional air flowing in as the cycle repeats back at the position in FIG. 4A.

Figure 5:
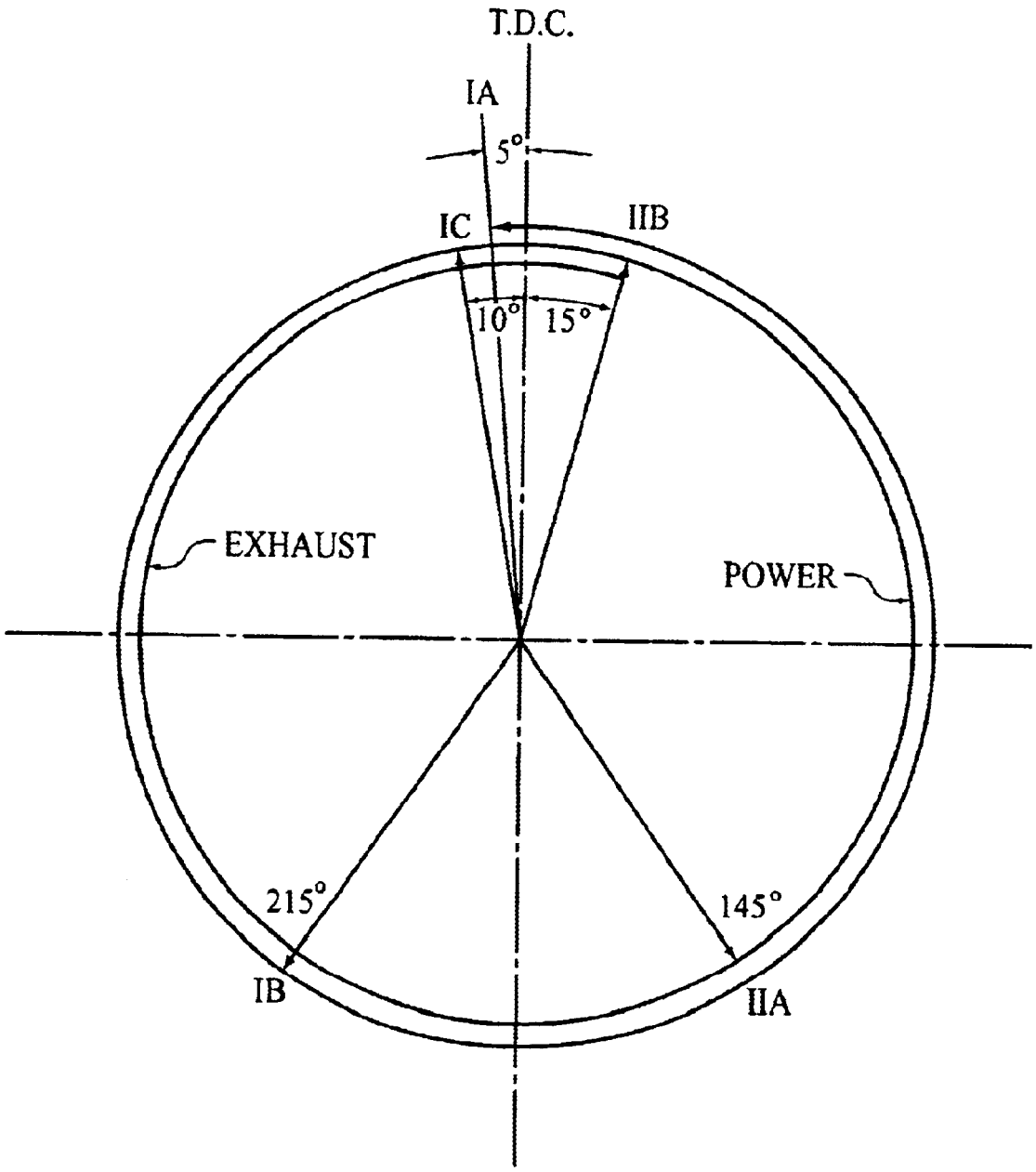
FIG. 5 is the radial diagram showing the progress of the four strokes shown in FIGS. 4A–4D.

This cycle process is shown in greater detail in FIG. 5 which shows the radial diagram showing the progress of the four strokes shown in FIGS. 4A–4D. As shown in this diagram, intake lifter 34 remains in an up position from a radial direction or position of −5° to 215°. In this position, in the first revolution of the crank shaft from point IA to point IB, the intake lifter remains open. After point IB, the intake lifter closes and the cylinder is at the start of the compression cycle as shown in FIG. 4B. The compression stroke continues until point IC which is shown as position −10° before a total rotation of the crank shaft. From position IC to position IIA, the cylinder starts on a power stroke as shown in FIG. 4C. Finally at position IIA, exhaust lifter 36 raises up to open exhaust port 18" releasing gasses from cylinder 14. Finally, exhaust lifter 36 remains open until point IIB which is 15° after the second full rotation of the crank shaft. From the position of 5° before this full rotation, until 15° after, both the intake lifter 34 and the exhaust lifter 36 are open allowing air to flow through the entire cylinder to clean the combusted gasses out of cylinder 14. During these four strokes, because intake lifter 34 and exhaust lifter 36 are driven by intermittent contact with cam discs 30 and 32 respectively, these lifters 34 and 36 undergo less wear and stress than lifters that are in constant contact with driving cam discs.

Accordingly, while at least one embodiment of the present invention has been shown and described, it is to be understood that many changes and modifications may be made thereunto without departing from the spirit and scope of the invention as defined in the appended claims.

What is claimed is:

1. An internal combustion engine having a unitary engine block, and intake and an exhaust lifter system, the engine comprising:

a) at least one cylinder disposed in the unitary engine block, said at least one cylinder having an intake port and an exhaust port;

b) a power piston disposed in said at least one cylinder;

c) a crank shaft disposed in the engine block and extending through said at least one cylinder, said crank shaft being driven by a movement of said power piston;

d) a cam shaft being disposed within and extending through the engine block;

e) a timing chain being coupled to said crank shaft and said cam shaft wherein as said crank shaft rotates, it drives said timing chain which in turn rotates said cam shaft;

f) an intake lifter disposed in said at least one cylinder adjacent to said cylinder intake port;

g) an exhaust lifter disposed in said at least one cylinder adjacent to said exhaust port; and h) at least one oblong cam disc coupled to said cam shaft wherein said at least one oblong cam disc is for driving said intake lifter and said exhaust lifter intermittently so that exhaust can flow through said piston from said intake port and out of said exhaust port.

2. The intake and exhaust system as in claim 1, further comprising at least one stationary plate and at least one intake spring disposed in said at least one intake cylinder on said at least one stationary plate, and at least one exhaust spring disposed in said at least one exhaust cylinder on said at least one stationary plate wherein said at least one intake spring, spring loads said intake lifter for reciprocal motion within said at least one intake cylinder and said at least one exhaust spring, spring loads said exhaust lifter for reciprocal motion in said at least one exhaust cylinder.

3. The device as in claim 2, further comprising a supplemental shaft slidably coupled to said stationary plate, and coupled to said intake lifter and further comprising at least one oil pump disposed within said at least one intake cylinder wherein said at least one oil pump is for providing intermittent oil pressure to drive said supplemental shaft within said stationary plate to create a reciprocating movement of said intake lifter within said at least one intake cylinder.

4. The device as in claim 3, wherein said oil pump includes an oil pressure roller and an oil pressure shaft coupled to said oil pressure roller, wherein said oil pressure roller is in communication with said timing chain such that it rotates with said timing chain as said timing chain is being driven along by said crankshaft, and wherein said oil pressure shaft rotates with said oil pressure roller to create intermittent oil pressure causing said supplemental shaft to create a reciprocal motion in said intake lifter.

5. An internal combustion engine including an engine block and an oil pan the engine comprising:

a) at least one power cylinder disposed in the engine block and having a first end and a second end, said first end being coupled to the oil pan;

b) at least one intake cylinder disposed in the engine block adjacent to said at least one power cylinder and having at least one intake port;

c) at least one exhaust cylinder disposed in the engine block adjacent to said at least one power cylinder and said at least one intake cylinder and having at least one exhaust port;

d) a power piston disposed in said at least one power cylinder;

e) a crank shaft disposed in the engine block and extending through said at least one power cylinder, said crank shaft being driven by a movement of said power piston;

f) a cam shaft being disposed within the engine block, and extending through the engine block;

g) a timing chain being coupled to said crank shaft and said cam shaft wherein as said crank shaft rotates, it drives said timing chain which in turn rotates said cam shaft;

h) an intake lifter disposed in said at least one intake cylinder adjacent to said intake cylinder intake port;

i) an exhaust lifter disposed in said at least one cylinder adjacent to said exhaust port; and j) at least one oblong cam disc coupled to said cam shaft wherein said at least one oblong cam disc is for driving said intake lifter and said exhaust lifter intermittently so that exhaust can flow through said intake cylinder and said exhaust cylinder from said intake port and out of said exhaust port;

k) a cover, coupled to said second end of said at least one power cylinder, wherein said at least one power cylinder is designed to form a single unitary engine block incorporating a cylinder head and an engine block in one single casting, and wherein said cover is removably secured to said at least one power cylinder such that said cover can be easily removable from said at least one power cylinder.

6. The intake and exhaust system as in claim 5, further comprising at least one stationary plate and at least one intake spring disposed in said at least one intake cylinder on said at least one stationary plate, and at least one exhaust spring disposed in said at least one exhaust cylinder on said at least one stationary plate wherein said at least one intake spring, spring loads said intake lifter for reciprocal motion within said at least one intake cylinder and said at least one exhaust spring, spring loads said exhaust lifter for reciprocal motion in said at least one exhaust cylinder.

7. The device as in claim 2, further comprising a supplemental shaft slidably coupled to said stationary plate, and coupled to said exhaust lifter and further comprising at least one oil pump disposed within said at least one exhaust cylinder wherein said at least one oil pump is for providing intermittent oil pressure to drive said supplemental shaft within said stationary plate to create a reciprocating movement of said exhaust lifter within said at least one exhaust cylinder.

8. The device as in claim 6, wherein said oil pump includes an oil pressure roller and an oil pressure shaft coupled to said oil pressure roller, wherein said oil pressure roller is in communication with said timing chain such that it rotates with said timing chain as said timing chain is being driven along by said crankshaft, and wherein said oil pressure shaft rotates with said oil pressure roller to create intermittent oil pressure causing said supplemental shaft to create a reciprocal motion in said exhaust lifter.

* * * * *